US011491630B2

(12) United States Patent
Chen

(10) Patent No.: US 11,491,630 B2
(45) Date of Patent: Nov. 8, 2022

(54) 2-IN-1 CLAMP AND WRENCH

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 485 days.

(21) Appl. No.: 16/546,137

(22) Filed: Aug. 20, 2019

(65) Prior Publication Data

US 2020/0061793 A1 Feb. 27, 2020

Related U.S. Application Data

(60) Provisional application No. 62/720,725, filed on Aug. 21, 2018.

(51) Int. Cl.

| | |
|---|---|
| ***B25F 1/00*** | (2006.01) |
| ***B25F 1/04*** | (2006.01) |
| ***B25B 5/02*** | (2006.01) |

(52) U.S. Cl.

CPC ..... *B25F 1/003* (2013.01); *B25F 1/04* (2013.01); *B25B 5/02* (2013.01)

(58) Field of Classification Search

CPC ..... B25F 1/003; B25F 1/04; B25B 5/02
USPC ..... 7/138; 81/358, 359, 489, 356
See application file for complete search history.

(56) References Cited

U.S. PATENT DOCUMENTS

| | | | | | |
|---|---|---|---|---|---|
| 884,422 | A * | 4/1908 | Schmitt | B25B 7/04 | 81/316 |
| 1,453,155 | A * | 4/1923 | Matias | B25F 1/006 | 81/166 |
| 3,354,755 | A * | 11/1967 | Legrande | B25B 5/068 | 81/314 |
| 4,793,225 | A * | 12/1988 | Berkich | B25B 7/12 | 81/356 |
| 5,685,205 | A * | 11/1997 | Suksi | B25B 7/00 | 81/165 |
| 2019/0351532 | A1* | 11/2019 | Lai | B25B 5/02 | |

* cited by examiner

*Primary Examiner* — Hadi Shakeri
(74) *Attorney, Agent, or Firm* — Weide & Miller, Ltd.

(57) ABSTRACT

A combination clamp and wrench tool includes a main body, a fixed jaw attached the main body, and a floating clamp mechanism. The floating clamp mechanism may include an adjustable jaw. The floating clamp mechanism may be attached to the main body such that the floating clamp mechanism is slidable relative to the main body towards and away from the fixed jaw. The worm gear and the rack are attached to the floating clamp mechanism. Actuation of the worm gear moves the rack linearly relative to the floating clamp mechanism. When the rack is moved to contact the fixed jaw, the combination clamp and wrench tool operates in a wrench mode, and when the rack is moved away from the fixed jaw, the combination clamp and wrench tool operates in a clamp mode.

18 Claims, 4 Drawing Sheets

2-IN-1 CLAMP AND WRENCH

CROSS-REFERENCE TO RELATED APPLICATION

This application claims priority to U.S. Provisional Application No. 62/720,725 which was filed on Aug. 21, 2018, the contents of which are incorporated by reference.

BACKGROUND

Professional contractors, do-it-yourselfers, and hobbyists alike all require a variety of different tools to complete various projects. There are all kinds of available tools designed to aid in just about any conceivable task. As a result, many of the above-mentioned people accumulate several different tools. While some people may enjoy a large tool collection, the growing stockpile of tools requires storage and ways to transport the needed tools to a job site.

To save space for both storage and transport, tools that have multiple applications are often desirable. Not only does this reduce an amount of space needed for storage and transport, but fewer tools may often make work at a job site simpler.

SUMMARY

Accordingly, a new combination clamp and wrench is disclosed herein. The combination clamp and wrench may provide both a clamping functionality and a wrenching functionality in a single tool, thereby saving a user space in both storage and transport.

In one exemplary embodiment, a combination clamp and wrench tool includes a main body, a fixed jaw attached the main body, and a floating clamp mechanism. The floating clamp mechanism may include an adjustable jaw. The floating clamp mechanism may be attached to the main body such that the floating clamp mechanism is slidable relative to the main body towards and away from the fixed jaw.

In some instances, the main body may include an elongated slot. The floating clamp mechanism may attach to the main body via the elongated slot to facilitate the sliding motion. A toothed bar may be attached to the main body, and the floating clamp mechanism may include a pawl. The toothed bar and pawl together may define a ratchet that limits the motion of the floating clamp mechanism in a direction away from the fixed jaw. Or, stated differently, the ratchet limits the opening of the adjustable jaw relative to the fixed jaw.

A tapered plunger may be disposed on the main body. The tapered plunger may include a conical surface. The pawl may include a cam follower surface that interacts with the conical surface of the tapered plunger. In this manner the tapered plunger may disengage the pawl from the toothed bar to allow the motion of the floating clamp mechanism in the direction away from the fixed jaw. Or, in other words, the engagement of the tapered plunger with the pawl may allow the opening of the adjustable jaw relative to the fixed jaw.

In some embodiments, the combination clamp and wrench tool may include a worm gear and an associated rack. The worm gear and the rack are attached to the floating clamp mechanism. Actuation of the worm gear moves the rack linearly relative to the floating clamp mechanism. When the rack is moved to contact the fixed jaw, the combination clamp and wrench tool operates in a wrench mode, and when the rack is moved away from the fixed jaw, the combination clamp and wrench tool operates in a clamp mode.

In one embodiment, the floating clamp mechanism has, in addition to the adjustable jaw, a handle, a toggle link, and a sliding tie bar. The adjustable jaw, the handle, the toggle link, and the sliding tie bar define a four-bar clamping mechanism. The handle may also include a trigger configured to release the four-bar clamping mechanism from a clamped position.

In some embodiments, the worm gear and the rack may be attached to the adjustable jaw, and actuation of the worm gear causes linear motion of the rack relative to the adjustable jaw. The adjustable jaw may include a c-shaped channel and a rod extending through an opening in the adjustable jaw. The worm gear may be disposed in the opening around the rod, and the rack may be disposed within the c-shaped channel and may be configured to slide within the c-shaped channel.

In some embodiments, the pawl is attached to the sliding tie bar. The pawl may be configured to rotate about a pin, and the pawl may be biased to rotate into engagement with the toothed bar. In one embodiment, the main body includes a window, and the worm gear is accessible via the window.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
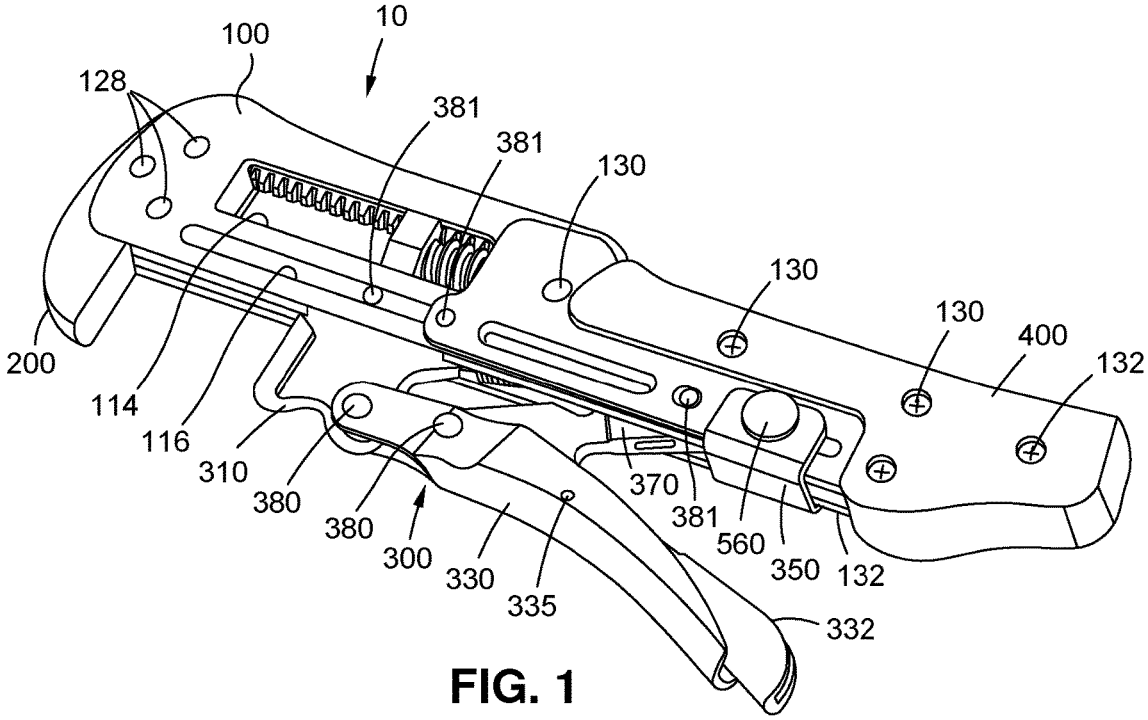
FIG. 1 shows a perspective view of a clamp and wrench combination tool according to an exemplary embodiment.

FIG. 1 shows a perspective view of a clamp and wrench combination tool according to an exemplary embodiment. A clamp and wrench combination tool 10 comprises a main body 100, a fixed jaw 200, a floating clamp mechanism 300, and a main body wrap 400. The fixed jaw 200 is securely attached to the main body 100, preferably in a fixed location relative to the main body, such as via fasteners 128 or by being formed as a portion of the main body 100. When fasteners 128 are utilized, they may be any suitable fasteners such as a bolt and nut, rivet, screws, etc. The body wrap 400 covers a lower portion of the main body 100. The body wrap 400 is comprised of a resilient, grippy material that increases the ergonomics of the tool 10 during use.

Figure 2:
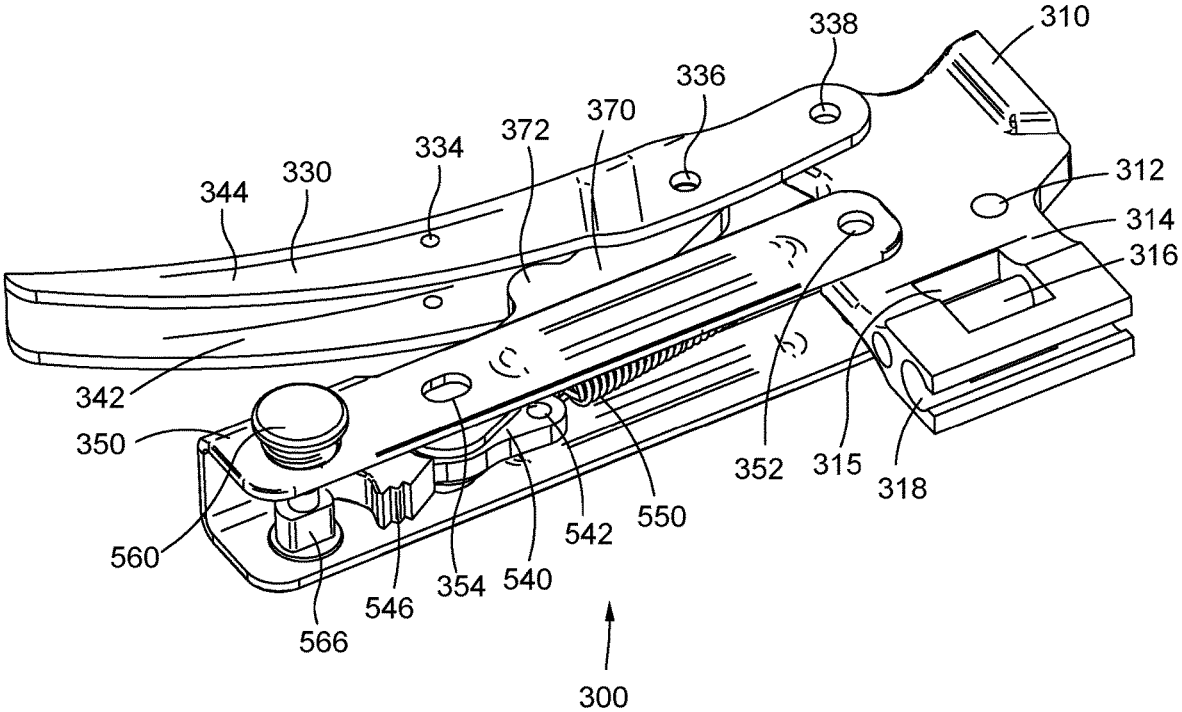
FIG. 2 shows a perspective view of a floating clamp mechanism for a clamp and wrench combination tool according to an exemplary embodiment.
Figure 4:
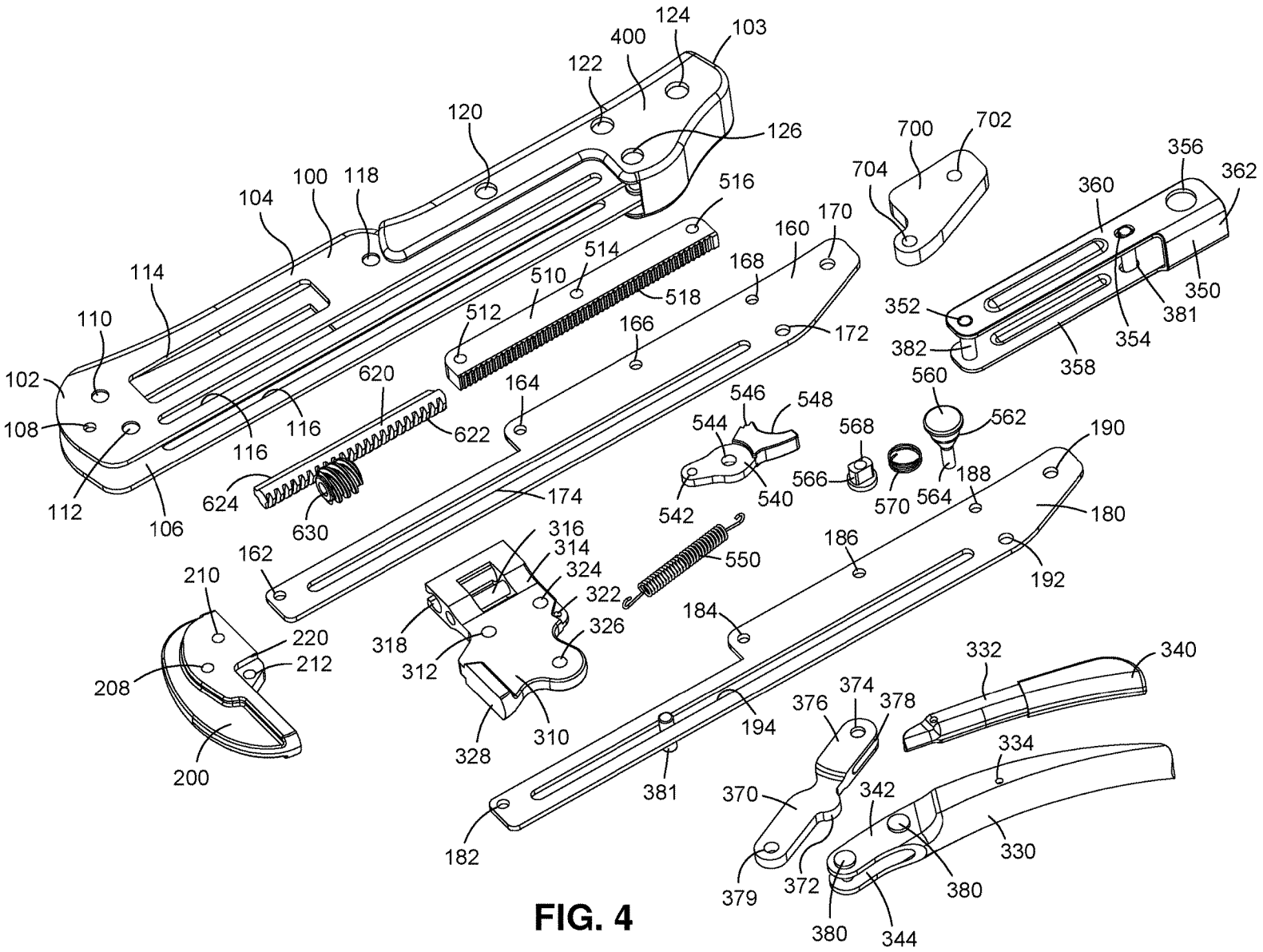
FIG. 4 shows a disassembled view of the clamp and wrench combination tool shown in FIG. 1.

The floating clamp mechanism 300 is attached to the main body 100. Unlike the fixed jaw 200, the floating clamp mechanism 300 is movably mounted to the main body 100. In one embodiment, the floating clamp mechanism 300 may be connected to the main body 100 via pins 381, as will be described in more detail below. FIG. 2 shows a perspective view of the floating clamp mechanism 300. Each of the individual components are shown in FIG. 4. Referring to FIG. 2, the floating clamp mechanism 300 includes an adjustable jaw 310. The adjustable jaw 310 works in tandem with the fixed jaw 200 in either a wrenching or a clamping operation, as will be explained below.

Still referring to FIG. 2, the adjustable jaw comprises a rearward flange 314. The flange 314 has opening 315 through which a rod 316 extends. Along the rear edge of the flange 314 there is a c-shaped channel 318. The rod 316 and c-shaped channel 318 help to facilitate the movement of the adjustable jaw 310 and floating clamp mechanism 300.

The adjustable jaw 310 further comprises apertures 312, 324, and 326 (see FIG. 4). Apertures 312 and 324 facilitate the connection of the adjustable jaw 310, and thus the floating clamp mechanism 300, to the main body 100. Apertures 324 and 326 facilitate connection of the adjustable jaw 310 with a handle 330 and a sliding tie bar 350.

The handle 330 is movably (preferably rotatably) connected to the adjustable jaw 310 via an aperture 338 through which a fastener 380 extends (see FIG. 1). More specifically, the handle 330 comprises two flanges 342, 344 (see FIG. 4) on one end that fit around the adjustable jaw 310. The fastener 380 extends through the aperture 338 in both flanges 336, 338 and through the aperture 326 of the adjustable jaw. As illustrated in FIG. 1, the handle 330 comprises a lock release trigger 332 that is movably (preferably rotatably) connected to the handle 330 via an aperture 334 (see FIG. 2) and pin 335. In some embodiments the lock release trigger 332 may have an ergonomic covering 340 (see FIG. 4) to provide a more resilient surface for a user when actuating the lock release trigger 332. The handle further comprises an aperture 336 that facilitates the connection of the handle to a toggle link 370 via a fastener 380.

As illustrated in FIG. 4, the sliding tie bar 350 connects to the adjustable jaw 310 and the main body 100 via aperture 352. The sliding tie bar 350 connects with the toggle link 370 and main body 100 via the elongated hole 354. The sliding tie bar 350 is formed with two parallel plates 358, 360 connected by a bridge member 362. The bridge member 362 connects the two parallel plates 358, 360 and maintains them in a fixed, spaced apart position. A plunger aperture 356 is disposed in the plate 360 adjacent to the bridging member 362.

The toggle link 370 is movably (preferably rotatably) connected to the sliding tie bar 350 by fitting between the plates 358, 360 and aligning aperture 374 in flange members 376, 378 (see FIG. 4) with the elongated hole 354 via pin 381. The toggle link 370 connects to the handle 330 by fitting the toggle link 370 within flange members 342, 344 of the handle 330 and aligning the aperture 379 of the toggle link 370 with aperture 336 of the handle 330. A fastener 380 extends through each of the apertures 379, 336.

The adjustable jaw 310, the handle 330, the sliding tie bar 350 and toggle link 370 create a four-bar clamping mechanism. Referring to FIG. 2, the first link may be defined as the sliding tie bar 350 from aperture 352 to elongated hole 354, the second link may be defined as the toggle link 370 from the elongated hole 354 to the aperture 336, the third link may be defined as the handle 330 from aperture 336 to 338, and the fourth link may be defined as the adjustable jaw 310 from aperture 338 to aperture 352, wherein each of those four links are rotatably connected, thus allowing relative movement between them.

The links are formed as a bi-stable four-bar linkage such that when the handle 330 is pulled away from the sliding tie bar 350, the floating clamp mechanism 300 is in an open position, and when the handle 330 is pushed towards the sliding tie bar 350, the floating clamp mechanism 300 is in a locked position. In this manner, when the floating clamp mechanism 300 is in an open position, a downward force applied to the adjustable jaw 310 tends to rotate the toggle link 370 away from the sliding tie bar 350. Alternatively, when the floating clamp mechanism 300 is in the locked position, a downward force applied to the adjustable jaw 310 tends to rotate the toggle link 370 towards the sliding tie bar 350, thus locking the mechanism into place.

As mentioned above and illustrated in FIGS. 1 and 4, the handle has a lock release trigger 332. The lock release trigger 332 aids to unlock to the floating clamp mechanism 300 by applying a force against a cam surface 372 of the toggle link 370. This separates the toggle link 370 and handle 330 forcing the floating clamp mechanism into the open position. The elongated hole 354 allows for slight movement of the adjustable jaw 310 to aid in the clamping operation.

The floating clamp mechanism 300 is attached to the main body 100 such that the entire clamp mechanism 300 may move along the length of the main body 100. Referring to FIG. 4, the main body is formed with two parallel plates 104, 106. In each plate 104, 106 is a window 114 and a slot 116. The floating clamp mechanism 300 is attached to the main body via the slot 116 so that the clamp mechanism 300 slides along the slot 116. For example, aperture 312 of the adjustable jaw 310 is aligned with the slot 116 between the parallel plates 104, 106, and a pin 381 extends through the slot 116 and aperture 312. The aperture 324 of the adjustable jaw 310 and the aperture 352 of the sliding tie bar 350 are aligned with the slot 116. The adjustable jaw 310 is inserted between the parallel plates 104, 106 of the main body 100, and the parallel plates 358, 360 of the sliding tie bar 350 surround the parallel plates 104, 106 of the main body. A pin 381 connects the adjustable jaw 310, sliding tie bar 350, and main body 100 together.

Figure 3A:
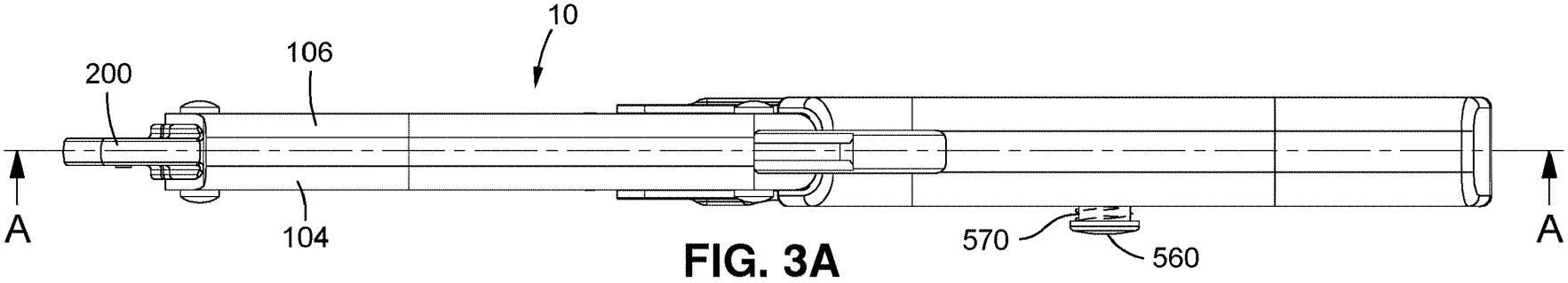
FIGS. 3A and 3B show a rear view and a cut-away view of the clamp and wrench combination tool shown in FIG. 1.
Figure 3B:
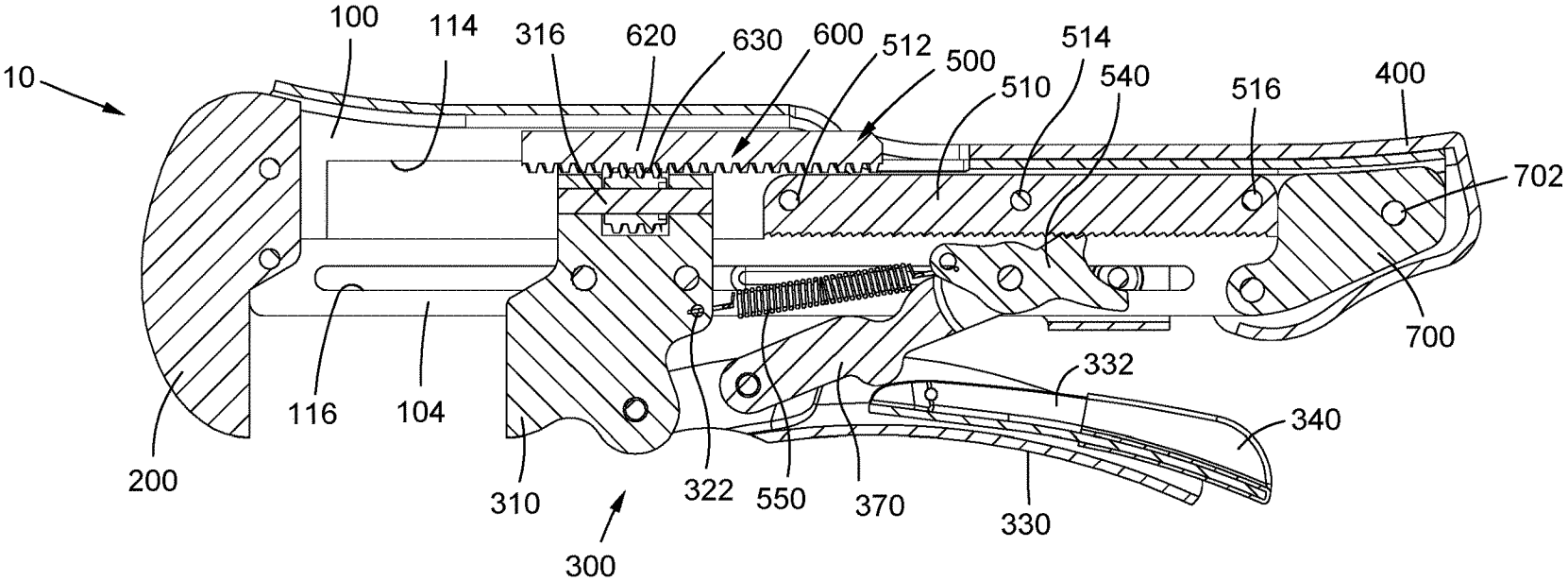

As illustrated in FIG. 3B, a primary adjustment mechanism 500 and a secondary adjustment mechanism 600 are provided. The primary adjustment mechanism 500 may be a linear ratcheting system. The primary adjustment mechanism 500 is provided and housed within the main body 100 to control the movement of the floating clamp mechanism 300 with respect to the main body. As illustrated in FIG. 4, the primary adjustment mechanism 500 comprises a toothed bar 510. Referring to FIGS. 1 and 4, the toothed bar 510 is disposed between the parallel plates 104, 106 of the main body with apertures 512, 514, 516 of the toothed bar 510 aligning with apertures 118, 120, 122 of the main body, respectively. As illustrated in FIG. 1, fasteners 130 mount the toothed bar 510 to the main body 100. Referring again to FIG. 4, the toothed bar 510 comprise a plurality of teeth 518. The teeth 518 may be configured as a ratchet with each tooth having a moderate slope on one edge and a much steeper slope on the other edge.

Referring to FIGS. 2 and 4, the primary adjustment mechanism 500 further comprises a pawl 540. The pawl 540 comprises an aperture 544 that is aligned with the elongated hole 354 of the sliding tie bar 350 and the aperture 374 of the toggle link 370. The pawl 540 fits between the flange members 376, 378 of the toggle link 370 and is rotatable about the pin 381. The pawl 540 further comprises teeth 546 that correspond to and engage with the teeth 518 of the toothed bar 510. Aperture 542 is configured to receive an end of a tension spring 550. The tension spring 550 is also connected to an aperture 322 on the adjustable jaw 310. The tension spring 310 biases the pawl 550 to rotate such that the teeth 546 of the pawl tend to remain in contact with the teeth 518 of the toothed bar.

The primary adjustment mechanism 500 includes a release mechanism, and in particular a pawl 540 release mechanism. In one embodiment, a curved cam follower surface 548 is disposed adjacent to the teeth 546 on the pawl 540. The cam follower surface 548 follows a conical surface 562 of a tapered plunger 560 that acts as a linear cam. That is, as the tapered plunger 560 is pressed and moved linearly inward (toward the main body 100) the conical surface 562 pushes the follower surface to cause the pawl 540 to rotate to disengage the teeth 546 of the pawl 540 from the teeth 518 of the toothed bar 510.

The tapered plunger 560 has a cylindrical portion 564 below the conical surface 562. The cylindrical portion 564 is received into an opening 568 of the push button base 566. The tapered plunger 560 and push button base 566 are aligned with the aperture 356 of the sliding tie bar 350 with the cylindrical portion 564 extending through the slot 116 of the main body. A compression spring 570 is provided which acts on the sliding tie bar 350 and tapered plunger 560 to bias the tapered plunger 560 away from the sliding tie bar 350. Thus, the default positioning of the pawl 540 is to be engaged with the toothed bar 510.

Accordingly, as illustrated in FIG. 4, if a user desires to move the adjustable jaw 310 towards a top end 102 of the main body 100 and closer to the fixed jaw 200, the user may slide the floating clamp mechanism 300 towards the top end 102. The pawl 540 and toothed bar 510 are configured to allow the floating clamp mechanism 300 to move in this direction without disengaging the pawl 540 from the toothed bar 510. When the adjustable jaw 310 is in the desired position, the pawl 540 prevents the floating clamp mechanism 300 from traveling away from the fixed jaw 200 towards the bottom end 103 via the interaction of the pawl teeth 546 with the teeth 518 of the toothed bar 510.

Alternately, if a user desires to move the adjustable jaw 310 away from the fixed jaw 200 towards the bottom end 103 of the main body, the user may engage the tapered plunger 560 so that the conical surface 562 interacts with the cam follower surface 548 to rotate the pawl 540 away from the toothed bar 510 to disengage from the toothed bar 510. While the pawl 540 is disengaged from the toothed bar 510, the floating clamp mechanism 300 may be moved away from the fixed jaw 200 towards the bottom end 103 of the main body 100.

As illustrated in FIGS. 3 and 4, the secondary adjustment mechanism 600 comprises a rack 620 and a corresponding worm gear 630. The worm gear 630 is disposed in the opening 315 of the adjustable jaw 310 and is mounted on the rod 316. Thus, the worm gear 630 is configured to rotate about the rod 316. The rack 620 comprises teeth 622 on one side and a flared edge 624 on an opposite side. The profile of the flared edge 624 fits within the c-shaped channel 318 of the adjustable jaw 310. In this way the worm gear 630 and rack 620 move with the floating clamp mechanism 300 by way of the attachment to the adjustable jaw 310. When the worm gear 630 is rotated, it causes the rack 620 to slide within the c-shaped channel 318 and move relative to the adjustable jaw. In particular, as described below, the worm gear 630 may be used to move the rack 620 towards and away from the fixed jaw 200, independent of movement of the adjustable jaw 310.

The worm gear 630 is accessible via the window 114 formed in the two parallel plates of the main body 104, 106. When the user actuates the worm gear 630, the user may set a size for the clamp and wrench combination tool 10 to operate in the wrench mode.

As illustrated in FIG. 4, in some embodiments, a spacer 700 may be provided. The spacer 700 comprises apertures 702, 704. The apertures 702, 704 correspond with apertures 124, 126 in the main body 100. The spacer 700 is thus disposed towards the bottom end 103 of the main body 100 to provide further structural rigidity to the tool 10. In some embodiments, the spacer may be attached to the main body 100 via fasters 132 (see FIG. 1).

The fixed jaw 200 is disposed on the top end 102 of the main body 110. The fixed jaw 200 includes apertures 208, 210, 212 that are configured to align with apertures 108, 110, 112 of the main body 100 to facilitate the attachment thereto. An indented portion 220 is provided surrounding the aperture 212 that helps to align the placement of body plates 160, 180.

As illustrated in FIG. 4, the body plates 160, 180 are disposed adjacent to the inner sides of the parallel plates 104, 106 of the main body 100. The body plates include slots 174, 194 that correspond with the slot 116 of the main body 100. The body plates further comprise apertures 162, 182 that are configured to align with apertures 112 of the main body 100; apertures 164, 184 that are configured to align with apertures 118 of the main body 100; apertures 166, 186 that are configured to align with apertures 120 of the main body 100; apertures 168, 188 that are configured to align with apertures 122 of the main body 100; apertures 170, 190 that are configured to align with apertures 124 of the main body 100; and apertures 172, 192 that are configured to align with apertures 126 of the main body 100.

Thus, given the above, the clamp and wrench combination tool 10 is assembled via aligning the various parts as described above and connecting the parts with the above-described pins and fasteners resulting in the assembled tool 10 as shown in FIG. 1. The operation of the assembled clamp and wrench combination tool 10 in both a clamping mode and a wrench mode will now be described with reference to FIGS. 5 and 6.

Figure 5:
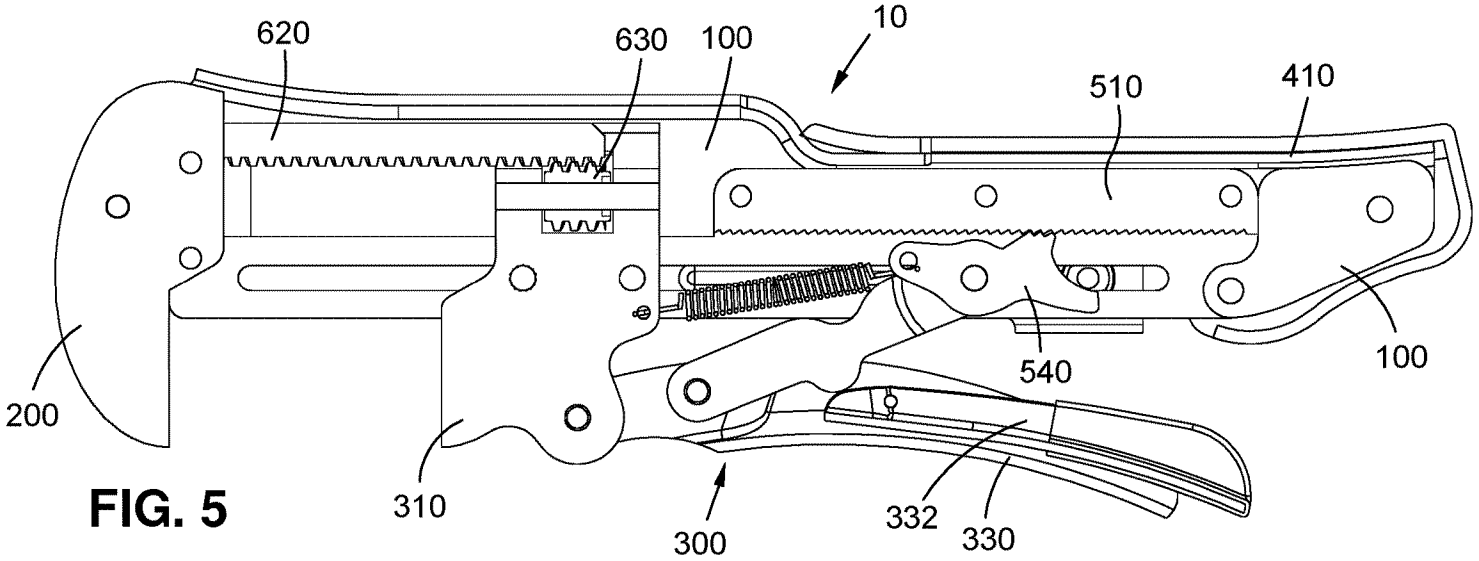
FIG. 5 shows a first mode of operation for a clamp and wrench combination tool according to one exemplary embodiment.

FIG. 5 shows a first mode of operation for a clamp and wrench combination tool according to one exemplary embodiment. In FIG. 5, the clamp and wrench combination tool 10 is shown in a wrench mode. In this mode, the adjustable jaw is moved into a desired position using the floating clamp mechanism 300. Specifically, the floating clamp mechanism 300 may be pushed toward the fixed jaw 200 via the pawl 540 advancing up the toothed bar 510, or may be pushed away from the fixed jaw 200 by rotating the pawl 540 away from the toothed bar 510 via the tapered plunger 560 (not shown in FIGS. 5 and 6).

When the adjustable jaw 310 is in the desired position, the worm gear 630 (which the user may access through the window 114 of either of the plates 104, 106) is used to drive the rack 620 up towards and into contact with the fixed jaw 200. When the rack 620 is in contact with the fixed jaw as shown in FIG. 5, the handle 330 may be pushed towards the main body 100 to lock the adjustable jaw 310 in position. To release the floating clamp mechanism 300 to move it to another desired position, the trigger 332 is actuated to release the handle 330 and unlock the floating clamp mechanism 300.

Figure 6:
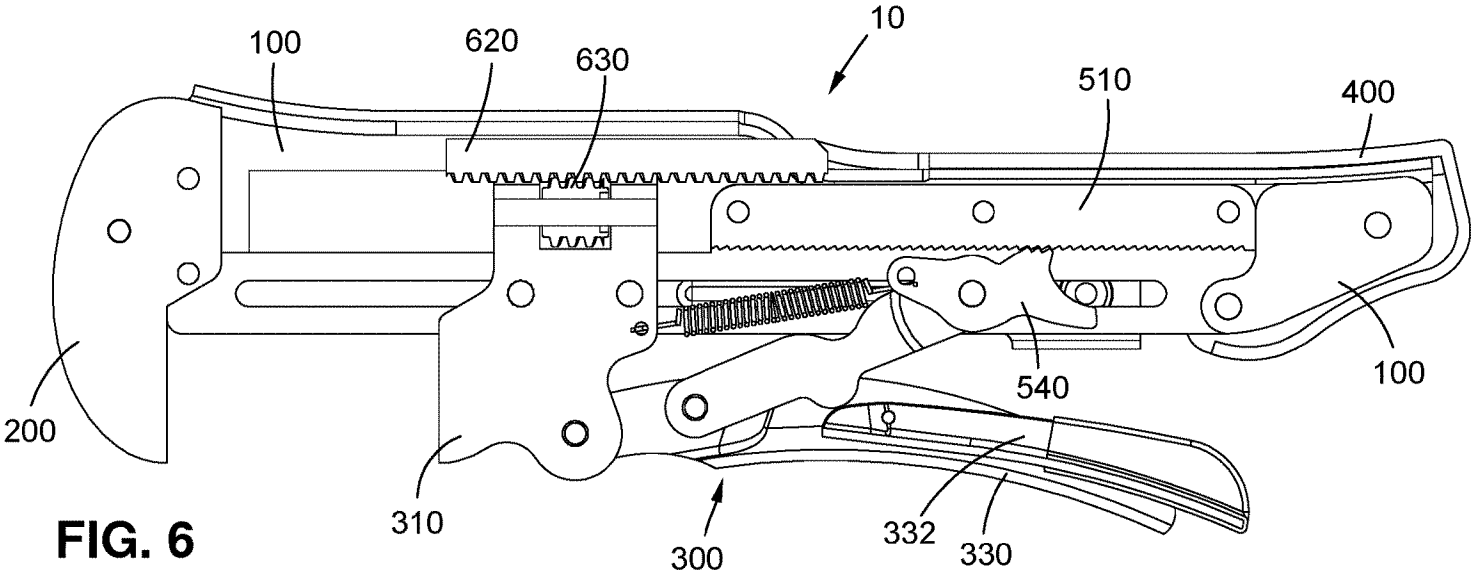
FIG. 6 shows a second mode of operation for a clamp and wrench combination tool according to one exemplary embodiment.

FIG. 6 shows a second mode of operation for a clamp and wrench combination tool according to one exemplary embodiment. In FIG. 6, the clamp and wrench combination tool 10 is shown in a clamping mode. In this mode, the adjustable jaw is moved into a desired position to fit an object which is to be clamped using the floating clamp mechanism 300. Specifically, the floating clamp mechanism 300 may be pushed toward the fixed jaw 200 via the pawl 540 advancing up the toothed bar 510, or may be pushed away from the fixed jaw 200 by rotating the pawl 540 away from the toothed bar 510 via the tapered plunger 560.

When the adjustable jaw 310 is in the desired position, the worm gear 630 is used to drive the rack 620 to ensure that the rack 620 is not in contact with the fixed jaw 200. With the rack 620 away from the fixed jaw 200 as shown in FIG. 6, an object may be clamped between the fixed jaw 200 and the adjustable jaw 310. This is done by pushing the handle 330 toward the main body 100 to clamp the object between the adjustable jaw 310 and the fixed jaw 200. To unclamp, the trigger 332 is actuated to release the handle 330 and unlock the floating clamp mechanism.

In this manner, a single tool may be provided for two different uses. For example, the clamp and wrench combination tool 10 may allow a user to carry and store a single too which provides both a clamping functionality, such as an F-clamp tool, and an adjustable wrench tool. This may aid to save the user time and storage space. It may further allow a user such as a contractor to carry less equipment to and from a job site.

In one embodiment, the tool 10 includes a primary adjustment mechanism 500 which comprises a toothed bar 510 which cooperates with a pawl 540. This mechanism may comprise one means for adjusting the position of the adjustable jaw 310 relative to the main body 100. It is contemplated that other means for adjusting or changing the position of the adjustable jaw 310 relative to the main body 100 may be utilized. For example, instead of a toothed bar 510, a smooth bar might be utilized. A slider might be located over the bar, which slider sits at an angle relative to the bar. The slider might include a biasing mechanism which causes it to bind on the bar when the slider is moved rearwardly (but not forwardly), and a release mechanism which allows the slider to either be moved out of engagement with the bar or have the angle thereof changed to permit it to be released from the bar so that it can be moved rearwardly.

In one embodiment, the tool 10 includes a secondary adjustment mechanism 600 which comprises a rack 620 and worm gear 630. This mechanism may comprise one means for setting a specified distance between the fixed jaw 200 and the adjustable jaw 310. It is contemplated that other means might be utilized. For example, other mechanisms (other than or cooperating with the worm gear 630) might be used to move the rack 620, such as a push-button or lever. In another embodiment, the worm gear 630 might be eliminated, such as by having a secondary toothed bar that the user might slide freely forward (towards the fixed jaw 200) relative to a secondary pawl, and which secondary pawl might be released to allow the secondary toothed bar to move rearwardly (where such movement might be biased, such as by a spring). In another embodiment, instead of a worm gear 630, a circular toothed gear might engage the rack 620. This toothed gear might be rotated by a knob which extends outwardly from one or both sides of the tool 10.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A combination clamp and wrench tool comprising:

a main body;

a fixed jaw attached to the main body;

a floating clamp mechanism comprising an adjustable jaw, the floating clamp mechanism being attached to the main body such that the floating clamp mechanism is slidable relative to the main body towards and away from the fixed jaw;

a toothed bar attached to the main body, wherein the floating clamp mechanism further comprises a pawl, and the toothed bar and pawl operate as a ratchet to limit motion of the floating clamp mechanism in a direction away from the fixed jaw; and a tapered plunger disposed on the main body, the tapered plunger having a conical surface, wherein the pawl comprises a cam follower surface that interacts with the conical surface of the tapered plunger to disengage the pawl from the toothed bar to allow the motion of the floating clamp mechanism in the direction away from the fixed jaw.

2. The combination clamp and wrench tool of claim 1, wherein the main body comprises an elongated slot and wherein the floating clamp mechanism attaches to the main body via the elongated slot.

3. The combination clamp and wrench tool of claim 1, further comprising a worm gear and an associated rack, the worm gear and the rack being attached to the floating clamp mechanism, and actuation of the worm gear causing linear motion of the rack relative to the floating clamp mechanism.

4. The combination clamp and wrench tool of claim 3, wherein when the rack is moved to contact the fixed jaw, the combination clamp and wrench tool operates in a wrench mode, and wherein when the rack is moved away from the fixed jaw, the combination clamp and wrench tool operates in a clamp mode.

5. The combination clamp and wrench tool of claim 1, wherein the floating clamp mechanism further comprises a handle, a toggle link, and a sliding tie bar; the adjustable jaw, the handle, the toggle link, and the sliding tie bar defining a four-bar clamping mechanism.

6. The combination clamp and wrench tool of claim 5, wherein the handle further comprises a trigger configured to release the four-bar clamping mechanism from a clamped position.

7. A combination clamp and wrench tool comprising:

a main body;

a fixed jaw attached to the main body;

a floating clamp mechanism comprising an adjustable jaw, the floating clamp mechanism being attached to the main body such that the floating clamp mechanism is slidable relative to the main body towards and away from the fixed jaw; and a worm gear and an associated rack, the worm gear and the rack being attached to the adjustable jaw, and actuation of the worm gear causing linear motion of the rack relative to the adjustable jaw, wherein the adjustable jaw comprises a c-shaped channel and a rod extending through an opening in the adjustable jaw, and wherein the worm gear is disposed in the opening around the rod and the rack is disposed within the c-shaped channel and is configured to slide within the c-shaped channel.

8. The combination clamp and wrench tool of claim 7, wherein when the rack is moved to contact the fixed jaw, the combination clamp and wrench tool operates in a wrench mode, and wherein when the rack is moved away from the fixed jaw, the combination clamp and wrench tool operates in a clamp mode.

9. The combination clamp and wrench tool of claim 7, further comprising a toothed bar attached to the main body, wherein the floating clamp mechanism comprises a pawl attached to a sliding tie bar, and the toothed bar and pawl operate as a ratchet to limit motion of the floating clamp mechanism in a direction away from the fixed jaw.

10. The combination clamp and wrench tool of claim 9, further comprising a tapered plunger disposed on the main body, the tapered plunger having a conical surface, wherein the pawl comprises a cam follower surface that interacts with the conical surface of the tapered plunger to disengage the pawl from the toothed bar to allow the motion of the floating clamp mechanism in the direction away from the fixed jaw.

11. The combination clamp and wrench tool of claim 9, wherein the pawl is configured to rotate about a pin, and the pawl is biased to rotate into engagement with the toothed bar.

12. The combination clamp and wrench tool of claim 7, wherein the main body further comprises a window, and the worm gear is accessible via the window.

13. A combination clamp and wrench tool comprising:

a main body;

a fixed jaw attached to the main body;

a floating clamp mechanism comprising an adjustable jaw, the floating clamp mechanism being attached to the main body such that the floating clamp mechanism is slidable relative to the main body towards and away from the fixed jaw;

a worm gear and an associated rack having a first end and a second end, the worm gear and the rack being attached to the floating clamp mechanism, and actuation of the worm gear causing linear motion of the rack relative to the floating clamp mechanism; and wherein the rack is movable between a first position and a second position, wherein in the first position the first end of the rack contacts the fixed jaw and the adjustable jaw is movable towards and away from said fixed jaw in a wrench mode, and wherein in the second position the first end of the rack does not contact the fixed jaw and the combination clamp and wrench tool operates in a clamp mode, wherein the floating clamp mechanism further comprises a handle, a toggle link, and a sliding tie bar; the adjustable jaw, the handle, the toggle link, and the sliding tie bar defining a four-bar clamping mechanism.

14. The combination clamp and wrench tool of claim 13, wherein the handle further comprises a trigger configured to release the four-bar clamping mechanism from a clamped position.

15. The combination clamp and wrench tool of claim 14, further comprising a tapered plunger disposed on the main body, the tapered plunger having a conical surface, wherein the pawl comprises a cam follower surface that interacts with the conical surface of the tapered plunger to disengage the pawl from the toothed bar to allow the motion of the floating clamp mechanism in the direction away from the fixed jaw.

16. The combination clamp and wrench tool of claim 13, further comprising a toothed bar attached to the main body, wherein the floating clamp mechanism further comprises a pawl, and the toothed bar and pawl operate as a ratchet to limit motion of the floating clamp mechanism in a direction away from the fixed jaw.

17. The combination clamp and wrench tool of claim 13, wherein in said clamp mode, said adjustable jaw is movable towards said fixed jaw by actuation of a handle.

18. The combination clamp and wrench tool of claim 17, wherein said handle is movable between an open and a closed position.

* * * * *